US005910027A

United States Patent [19]

Wayt et al.

[11] Patent Number: 5,910,027

[45] Date of Patent: Jun. 8, 1999

[54] CONNECTOR POSITION ASSURANCE

[75] Inventors: Roger W. Wayt, Dearborn; Brent A. Kuhn, Novi, both of Mich.

[73] Assignee: UT Automotive Dearborn, Inc., Dearborn, Mich.

[21] Appl. No.: 08/946,862

[22] Filed: Oct. 8, 1997

[51] Int. Cl.[6] ..... H01R 3/00

[52] U.S. Cl. ..... 439/489; 439/352

[58] Field of Search ..... 439/350, 352–358, 439/488, 489

[56] References Cited

U.S. PATENT DOCUMENTS

| | | | |
|---|---|---|---|
| 4,634,204 | 1/1987 | Detter et al. . | |
| 4,946,404 | 8/1990 | Takenouchi et al. | 439/352 |
| 5,292,258 | 3/1994 | Sakurai | 439/352 |
| 5,370,550 | 12/1994 | Alwine et al. | 439/352 |
| 5,624,271 | 4/1997 | Childs et al. | 439/352 |
| 5,672,073 | 9/1997 | Matsumura et al. | 439/188 X |

*Primary Examiner*—Khiem Nguyen
*Attorney, Agent, or Firm*—Howard & Howard

[57] ABSTRACT

The invention relates to a device for ensuring that a first and a second electrical connector are properly connected and locked together. The first electrical connector includes a latching member for latching two together when properly mated. A locking member is secured to the first electrical connector in a space between the first electrical connector and the latching member. The locking member is moveable between an unlocked and locked position and can only be moved to the locked position when the first electrical connector is latched to the second electrical connector.

17 Claims, 3 Drawing Sheets

CONNECTOR POSITION ASSURANCE

BACKGROUND OF THE INVENTION

This invention relates to an electrical connection with a releasable locking member that prevents accidental disconnection of the electrical connection.

Electrical connections in vehicles are typically made with mating plug-in connectors. It is important that these connections be made with speed and accuracy during the assembly process. It is also important that the connection does not become disconnected accidentally following assembly. In addition, it is desirable that the locking member be releasable to permit replacement of the connectors. A variety of locking devices have been designed to prevent accidental disconnection of electrical connections.

Current plug-in electrical connectors usually include a cantilevered latching member mounted on one of the electrical connectors and a slot for receiving the latching member in the other electrical connector. To prevent accidental disconnection of the connectors, a separate locking member that prevents displacement of the latching member from the slot is included. However, when the latching member is cantilevered, it may break off of the electrical connector. In some proposed systems, the locking member is not secured to either of the electrical connectors and can become dislodged or lost prior to assembly of the connection. In addition, many locking members can lock the connectors together even if the connectors are not properly mated. Therefore, it is desirable to provide an electrical connection having an improved latching member and a locking member that is secured to one of the connectors of the electrical connection and that can be moved to a locked position only when the connectors are properly mated.

SUMMARY OF THE INVENTION

In general terms, this invention provides a unique arrangement of a latching member and a locking member for an electrical connection that allows the latching member to be moved between an unlatched and a latched position and that secures the locking member to the connection wherein the locking member can be moved between an unlocked and locked position only when the connection is properly made.

Preferably, the electrical connection includes first and second matable electrical connectors. The first electrical connector includes a latching member spaced apart from the first electrical connector and attached at both ends on the first electrical connector. The first and second electrical connector are moveable relative to each other between an unlatched and a latched position. A locking member is received and secured between the latching member and the first electrical connector. The locking member is moveable relative to the first electrical connector between an unlocked position and a locked position. The locking member can only be moved to the locked position after the first and second electrical connectors are in the latched position, which occurs when they are properly mated. Thus, this invention assures that the electrical connectors are properly mated, that the locking member will remain associated with one of the connectors, and that the connectors will remain locked together.

These and other features and advantages of this invention will become more apparent to those skilled in the art from the following detailed description of the presently preferred embodiment. The drawings that accompany the detailed description can be described as follows:

DESCRIPTION OF THE PREFERRED EMBODIMENT

Figure 1:
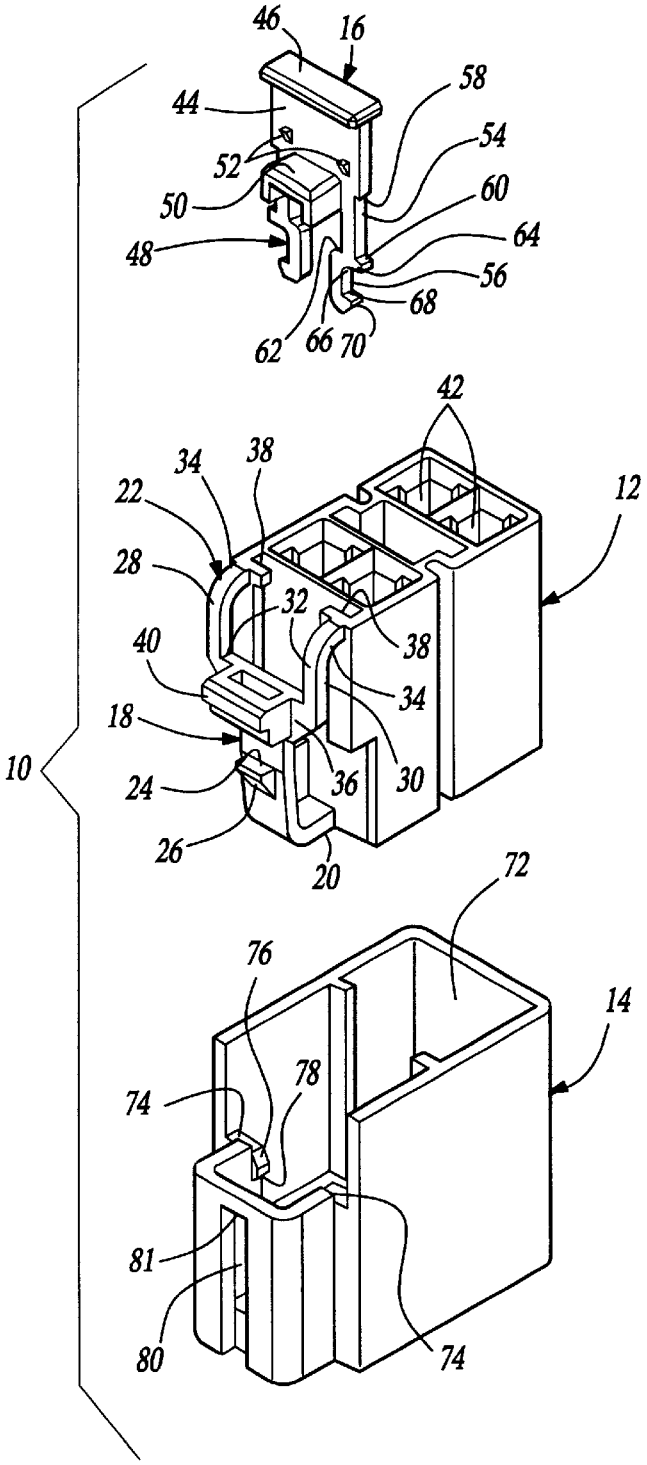
FIG. 1 is an exploded side view of an electrical connection designed according to this invention.

An electrical connection is generally indicated at 10 in FIG. 1. A first electrical connector 12, a second electrical connector 14, a locking member 16, and a latching member 18 define the electrical connection 10. The latching member 18 is attached at a first end 20 and a second end 22 to the first electrical connector 12. Most preferably, the latching member 18 is U-shaped and is molded as a unitary piece with the first electrical connector 12. A latching projection 24 is mounted on the first end 20 of the latching member 18. A ramped portion 26 forms one side of the latching projection 24. The second end 22 has a first arm 28 and a second arm 30, each of which has a first end 32 and a second end 34. The first end 20 of the latching member 18 and the first ends 32 of the first arm 28 and the second arm 30 are attached to a central portion 36. The second ends 34 of the first arm 28 and the second arm 30 are mounted forwardly of a pair of opposing slots 38 defined on first electrical connector 12. An unlatching boss 40 is mounted to the central portion 36. The first electrical connector 12 also includes several electrical terminals 42 for communicating with electrical inputs (not shown).

The locking member 16 includes a plate 44 with a tab handle 46 mounted on one end and a pair of beams 48 mounted on an opposite end. An upwardly projecting first boss 50 and a pair of prelock detents 52 are mounted to one side of the plate 44. Each of the beams 48 includes a first bar 54 that is parallel to a second bar 56. A proximal end 58 of the first bar 54 is attached to the plate 44. A distal end 60 of the first bar extends away from the plate 44 and terminates in an inward bend 62 opposite an outwardly projecting stop 64. A proximal end 66 of the second bar 56 attaches to the inward bend 62 and the second bar 56 extends away from the plate 44. A distal end 68 of the second bar 56 has an outward projection 70.

The second electrical connector 14 includes a space 72 for receiving the first electrical connector 12 and the latching member 18. A pair of locking detents 74 project into the space 72. Each locking detent 74 has an upper ramp 76 and a lower ramp 78. The second electrical connector 14 includes a slot 80 and a cross beam 81.

As will be appreciated by one of ordinary skill in the art. The electrical connection 10 could be designed such that the latching member 18 and the opposing slots 38 are located on the second electrical connector 14 and that the slot 80 and the locking detents 74 could be located on the first electrical connector 12 in order to accomplish the same connection.

Figure 2:
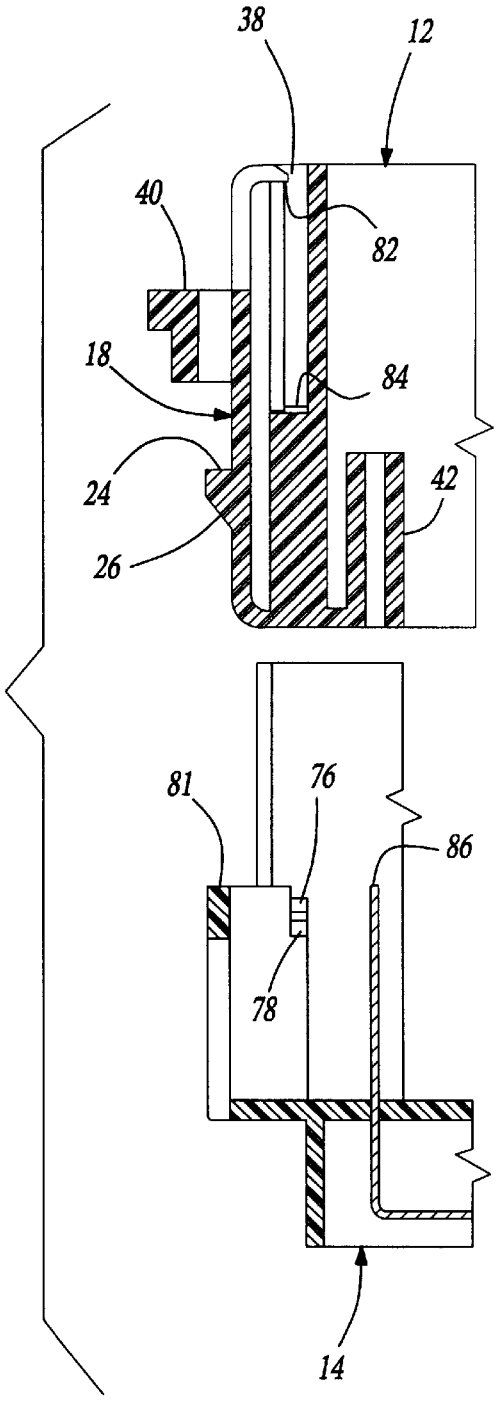
FIG. 2 is a cross-sectional view of electrical connectors designed according to this invention.

FIG. 2 is a cross-sectional view of the first electrical connector 12 and the second electrical connector 14. A prelock surface 82 and a locking stop 84 are located on opposite ends of each of the opposing slots 38. An electrical terminal 86 extends upward into the space 72 of the second electrical connector 14. The electrical terminal 86 is engaged by the terminals 42 in the first electrical connector 12. Terminals 86 and 42 are shown schematically, and their construction forms no part of this invention.

Figure 3:
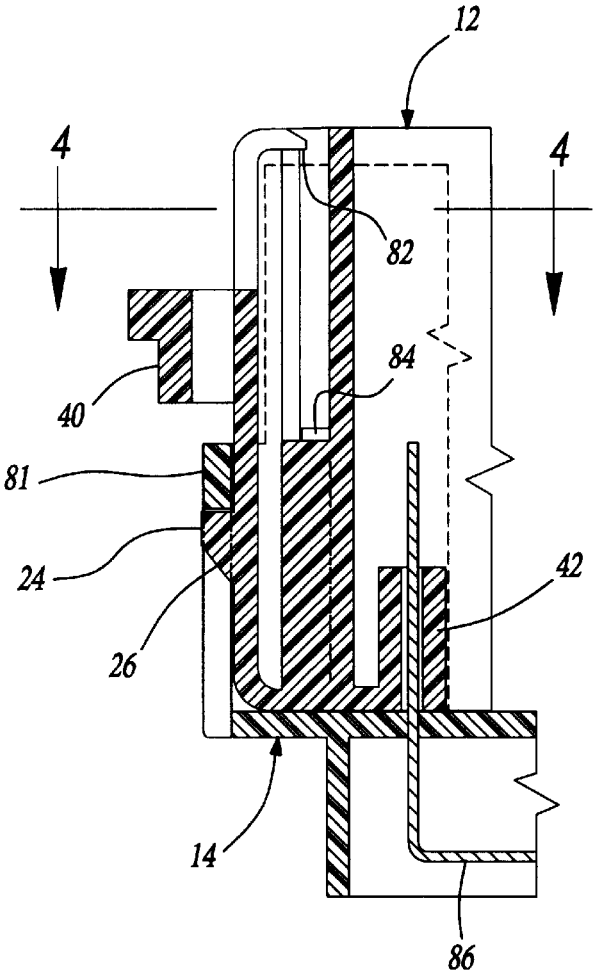
FIG. 3 is a cross-sectional side view of first and second electrical connectors designed according to this invention in a latched unlocked position.

FIG. 3 is a cross-sectional side view of the first electrical connector 12 and the second electrical connector 14 shown in a latched and unlocked position. The first electrical connector 12 is received in the space 72 of the second electrical connector 14. As the first electrical connector 12 is inserted into the second electrical connector 14, the ramped portion 26 of the latching projection 24 engages the cross beam 81 and deflects the latching member 18 inwardly toward the first electrical connector 12. When the latching projection 24 clears the cross beam 81, the latching member 18 springs outwardly away from the first electrical connector 12 and biases the latching projection 24 into the slot 80, thus latching the first electrical connector 12 to the second electrical connector 14. For clarity sake, the locking member 16 is not shown in FIG. 3.

Figure 4:
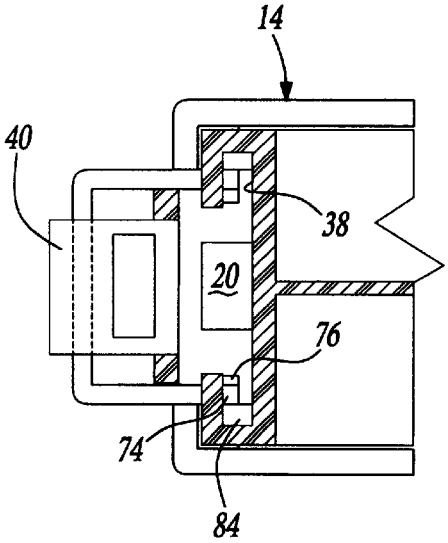
FIG. 4 is a top view of FIG. 3 in cross section along lines 4—4 of FIG. 3.

FIG. 4 is a top view of FIG. 3 in cross-section along lines 4—4 of FIG. 3. When the first electrical connector 12 and the second electrical connector 14 are in the latched and unlocked position, the unlatching boss 40 is located above the cross beam 81. The locking detents 74 are aligned with the slots 38. The locking stops 84 are positioned above the locking detents 74 and spaced apart from them.

Figure 5:
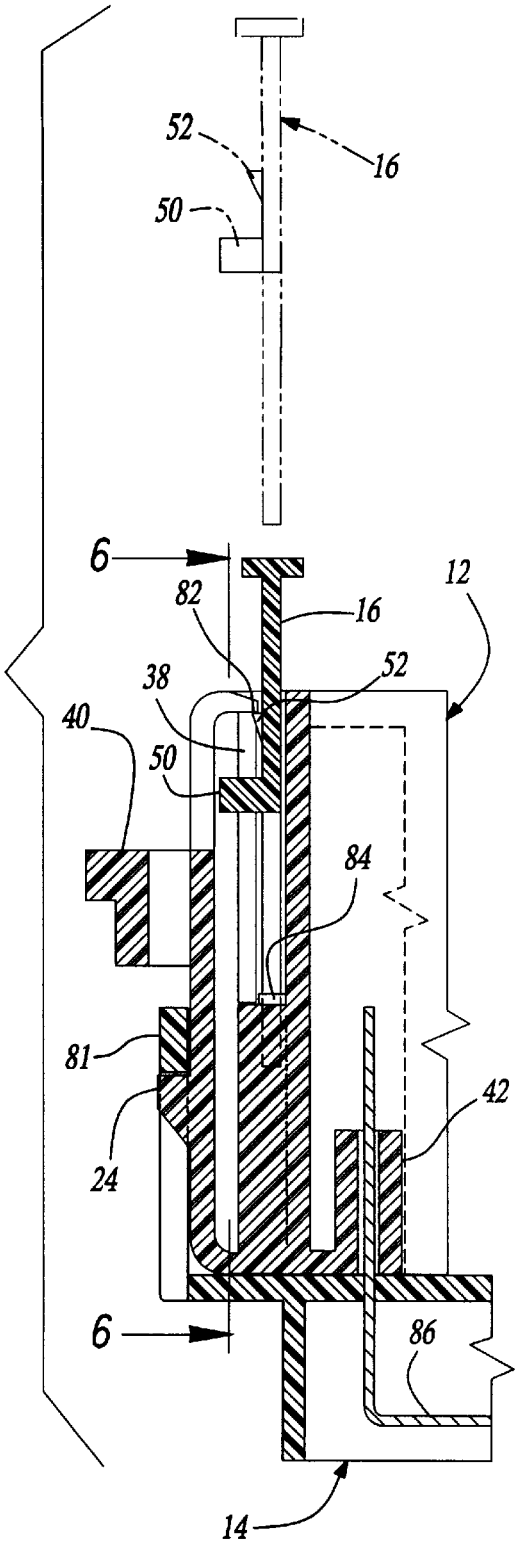
FIG. 5 is a cross-sectional side view of an electrical connector designed according to this invention in a latched and unlocked position with a locking member.

FIG. 5 is a cross-sectional side view of the electrical connection 10 in a latched and unlocked position with the locking member 16. Locking member 16 is slidably received and secured within slots 38 in the unlocked position. The locking member 16 is prevented from sliding out of the opposing slots by prelock detents 52 that are engaged by the prelock surfaces 82 in each of the opposing slots 38. While two detents are shown, only one prelock detent 52 engaged with one prelock surface 82 is necessary to secure the locking member 16 within the opposing slots 38. In the unlocked position, the first boss 50 is located above the unlatching boss 40 of the latching member 18. In the latched and unlocked position, moving the unlatching boss 40 toward the first electrical connector 12 will move the latching projection 24 out of the slot 80 and permit separation of the first electrical connector 12 from the second electrical connector 14.

Figure 6:
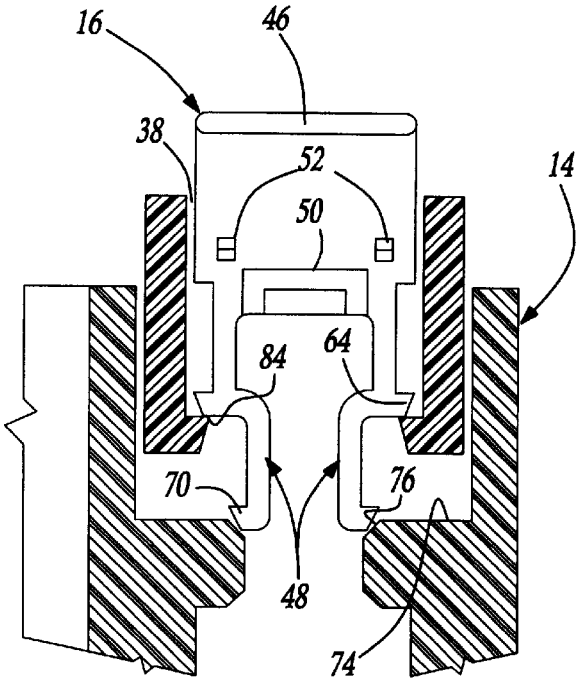
FIG. 6 is a cross-sectional front view of FIG. 5 along lines 6—6 of FIG. 5.

FIG. 6 is a cross-sectional front view of FIG. 5 along lines 6—6 of FIG. 5. When the first electrical connector 12 is latched to the second electrical connector 14, the outward projections 70 on the beams 48 are in contact with the upper ramp 76 of the locking detents 74. The outwardly projecting stops 64 of the beams 48 rest on the locking stops 84 within the slots 38.

Figure 7:
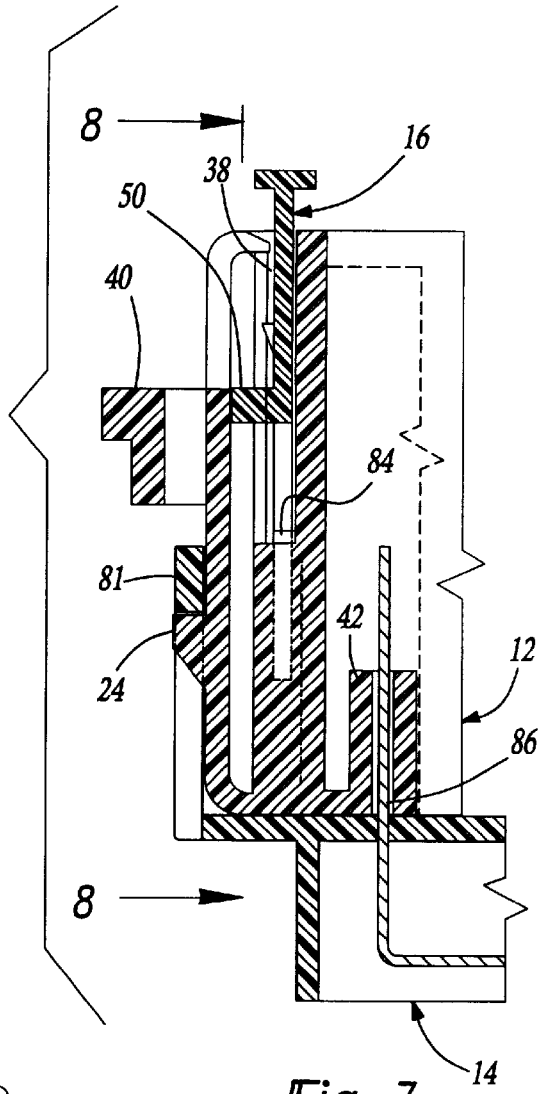
FIG. 7 is a cross-sectional side view of an electrical connector designed according to this invention in a latched and locked position.

FIG. 7 is a cross-sectional side view of the electrical connector 10 in the locked and latched position. In this position the first boss 50 is located behind the unlatching boss 40 and prevents any inward deflection of the latching member 16 toward the first electrical connector 12 and thus prevents unlatching of the first electrical connector 12 from the second electrical connector 14. As shown, terminals 42 and 86 are fully connected.

Figure 8:
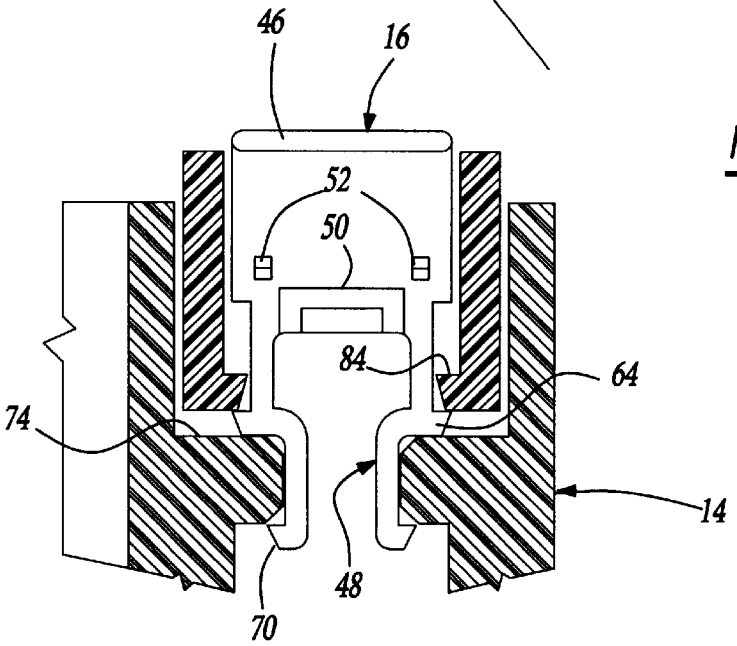
FIG. 8 is a cross-sectional front view of FIG. 7 along lines 8—8 of FIG. 7.

FIG. 8 is a cross-sectional front view of FIG. 7 along lines 8—8 of FIG. 7. Pushing the tab handle 46 downwardly from the FIG. 6 position, toward the second electrical connector 14 causes the outward projections 70 to ride the upper ramps 76 and deflects the beams 48 toward each other. This deflection permits the outwardly projecting stops 64 to move inside of the locking stops 84 and to move below the locking stops 84. This is the locked position. In the locked position, the outwardly projecting stops 64 rest between the locking stops 84 and the locking detents 74. First boss 50 is now positioned between the central portion 36 and the first electrical connector 12. In this position first boss 50 prevents inward deflection of the latching member 18 toward the first electrical connector 12. Thus, the first electrical connector 12 and the second electrical connector 14 are held in a latched and locked position.

It may sometimes be desirable to disconnect the first and second electrical connector 12, 14. If so, pulling the tab handle 46 upwardly away from the first electrical connector 12 engages the outward projections 70 with the lower ramps 78 of the locking detents 74 and moves the beams 48 toward each other. The deflection of the beams 48 permits the locking member 16 to be moved back to the unlocked position. Subsequent inward movement of the unlatching boss 40 permits the first electrical connector 12 to be separated from the second electrical connector 14.

The foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

We claim:

1. An electrical connection comprising:

a first electrical connector and a second electrical connector, said first electrical connector releasably matable with said second electrical connector;

a latching member having a first end, a second end, and an unlatching boss, said latching member spaced apart from and attached at said first and said second ends to said first electrical connector;

said first electrical connector and said second electrical connector moveable relative to each other between an unlatched and a latched position, said latching member releasably holding said first electrical connector and said second electrical connector at said latched position, and inward deflection of said unlatching boss permitting said first electrical connector and said second electrical connector to move to said unlatched position;

a locking member received between said latching member and said first electrical connector at an unlocked position; and said locking member being moveable relative to said first electrical connector to a locked position thereby preventing inward deflection of said unlatching boss and releasably securing said first and said second electrical connectors to each other when said first and said second electrical connectors are at said latched position, and said locking member not being moveable when said first and said second electrical connectors are at said unlatched position.

2. An electrical connection as recited in claim 1, wherein said locking member further comprises a plate having a first boss, said first boss preventing inward deflection of said latching member toward said first electrical connector when said locking member is at said locked position.

3. An electrical connection as recited in claim 1, wherein said first electrical connector has a pair of opposing slots between said latching member and said first electrical connector, at least one of said opposing slots having a prelock surface and a locking stop, said opposing slots receiving and guiding said locking member.

4. An electrical connection as recited in claim 3, wherein said locking member further comprises a plate having at least one prelock detent and a pair of beams extending from said plate, each of said beams having an outwardly projecting stop, said prelock detent and said outwardly projecting stop engaging said prelock surface and said locking stop respectively to hold said locking member at said unlocked position.

5. An electrical connection as recited in claim 4, wherein said second electrical connector includes a pair of locking detents for deflecting said beams toward each other when said first and said second electrical connector are at said latched position thereby permitting said locking member to move from said unlocked position to said locked position.

6. An electrical connection as recited in claim 1, wherein said latching member includes a latching projection, said latching projection releasably securing said first electrical connector to said second electrical connector when said first electrical connector and said second electrical connector are at said latched position.

7. An electrical connection comprising:

a first electrical connector including a latching member spaced apart from and attached at a first end and a second end to said first electrical connector;

a second electrical connector having a space for receiving said first electrical connector and said latching member, said first electrical connector and said latching member received in said space and moveable within said space between an unlatched and a latched position, said latching member releasably securing said first electrical connector to said second electrical connector at said latched position;

a locking member received between said first electrical connector and said latching member at an unlocked position; and said locking member being moveable relative to said first electrical connector to a locked position thereby releasably securing said first and said second electrical connector to each other when said first electrical connector and said latching member are at said latched position, and said locking member not being moveable when said first electrical connector and said latching member are at said unlatched position.

8. An electrical connection as recited in claim 7, wherein said locking member includes a plate having a pair of beams extending from said plate.

9. An electrical connection as recited in claim 8, wherein each of said beams further comprise a first bar parallel to a second bar, each of said first and said second bars having a proximal end and a distal end, said proximal end of said first bar attached to said plate, said distal end of said first bar having an outwardly projecting stop and opposite said stop an inward bend, said proximal end of said second bar attached to said inward bend, said distal end of said second bar extending away from said plate and having an outward projection.

10. An electrical connection as recited in claim 9, wherein said second electrical connector includes a pair of locking detents projecting into said space, said locking detents positioned apart to deflect said outward projections of said beams toward each other when said first and said second electrical connector are at said latched position thereby permitting said locking member to move from said unlocked position to said locked position.

11. An electrical connection as recited in claim 9, wherein said plate includes at least one prelock detent.

12. An electrical connection as recited in claim 11, wherein said first electrical connector includes a pair of opposing slots, each of said opposing slots having a prelock surface and a locking stop, said prelock detent and said outwardly projecting stop being received between said prelock surfaces and said locking stops when said locking member is at said unlocked position.

13. An electrical connection as recited in claim 7, wherein said second electrical connector includes a slot for receiving a latching projection mounted on said latching member, said latching projection securing said first and said second electrical connectors at said latched position.

14. An electrical connection comprising:

a first electrical connector including a latching member spaced apart from and attached at a first end and a second end to said first electrical connector;

a second electrical connector having a space for receiving said first electrical connector and said latching member, said first electrical connector and said latching member received in said space and moveable within said space between an unlatched and a latched position;

a locking member received between said first electrical connector and said latching member at an unlocked position;

said locking member being moveable relative to said first electrical connector to a locked position thereby securing said first and said second electrical connector when said first electrical connector and said latching member are at said latched position, and said locking member not being moveable when said first electrical connector and said latching member are at said unlatched position; and said locking member including a plate having a pair of beams extending from said plate, each of said beams comprising a first bar parallel to a second bar, each of said first and said second bars having a proximal end and a distal end, said proximal end of said first bar attached to said plate, said distal end of said first bar having an outwardly projecting stop and opposite said stop an inward bend, said proximal end of said second bar attached to said inward bend, said distal end of said second bar extending away from said plate and having an outward projection.

15. An electrical connection as recited in claim 14, wherein said second electrical connector includes a pair of locking detents projecting into said space, said locking detents positioned apart to deflect said outward projections of said beams toward each other when said first and said second electrical connector are at said latched position thereby permitting said locking member to move from said unlocked position to said locked position.

16. An electrical connection as recited in claim 14, wherein said plate includes at least one prelock detent.

17. An electrical connection as recited in claim 16, wherein said first electrical connector includes a pair of opposing slots, each of said opposing slots having a prelock surface and a locking stop, said prelock detent and said outwardly projecting stop being received between said prelock surfaces and said locking stops when said locking member is at said unlocked position.

* * * * *